US005626248A

United States Patent [19]

McConnell et al.

[11] Patent Number: 5,626,248

[45] Date of Patent: May 6, 1997

[54] THERAPEUTIC HAND-HELD DRINKING APPARATUS

[75] Inventors: Michael McConnell, Durham, N.H.; David L. McClees, Lewisoon, Me.

[73] Assignee: Talus Corporation, Westbrook, Me.

[21] Appl. No.: 422,860

[22] Filed: Apr. 17, 1995

[51] Int. Cl.[6] ..... B65D 1/00; B65D 1/04

[52] U.S. Cl. ..... 215/383; 446/77; 215/374; 220/756; 40/324; 40/666

[58] Field of Search ..... 446/77, 71, 73–75; 40/324, 666, 479, 440; 220/756, 758, 737, 739; 215/99.5, 1 R; D7/536, 537, 533, 509, 622

[56] References Cited

U.S. PATENT DOCUMENTS

| | | | |
|---|---|---|---|
| D. 350,457 | 9/1994 | Bailey . | |
| 476,343 | 6/1892 | White | 40/324 |
| 4,261,121 | 4/1981 | Coon | 40/666 X |
| 4,932,542 | 6/1990 | Chen et al. | 446/74 X |
| 5,031,803 | 7/1991 | Chen | 446/73 X |
| 5,339,549 | 8/1994 | David et al. | 40/324 |

FOREIGN PATENT DOCUMENTS

| | | | |
|---|---|---|---|
| 58088 | 3/1913 | Austria | 40/324 |

*Primary Examiner*—Mickey Yu

*Attorney, Agent, or Firm*—Poms, Smith, Lande & Rose Professional Corporation

[57] ABSTRACT

A hand-held drinking apparatus including a vessel having an open end and a closed end, a handle associated with the vessel and extending outwardly therefrom, and an object, such as a bead, mounted for rotation on the vessel or the handle.

22 Claims, 4 Drawing Sheets

Fig. 1.
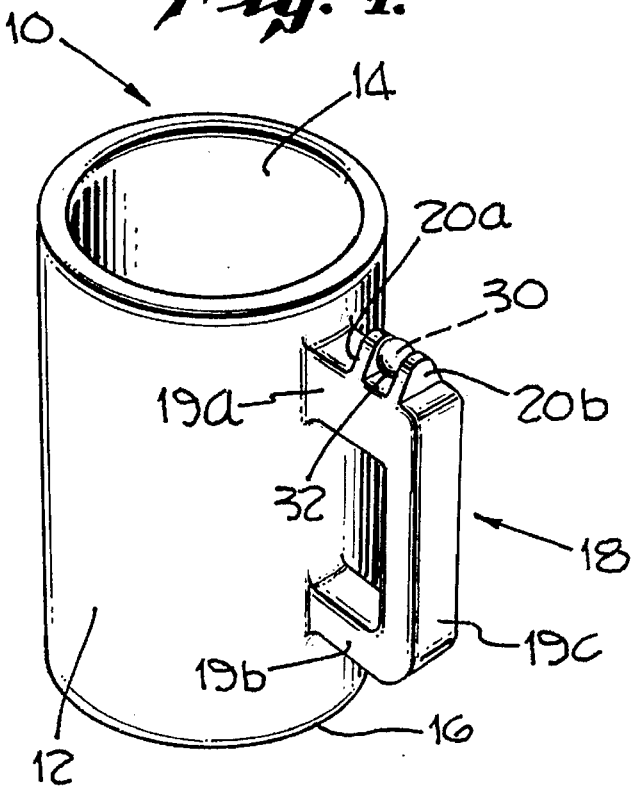
Fig. 4a.
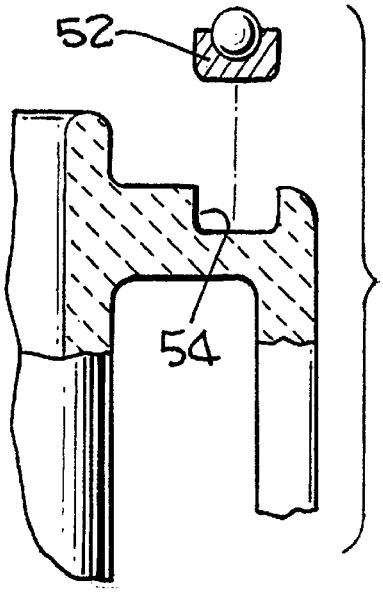
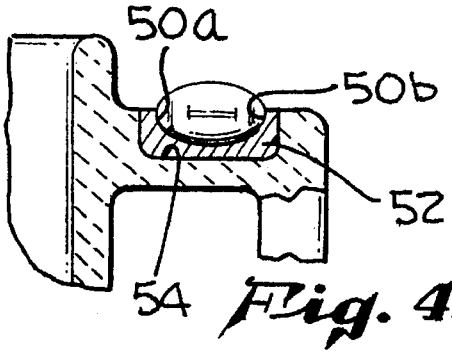
Fig. 4b.
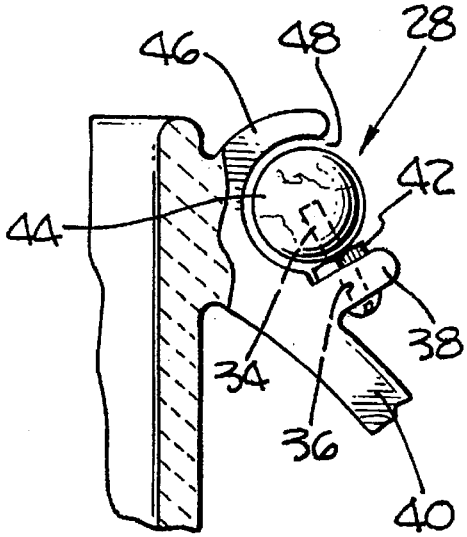
Fig. 3.
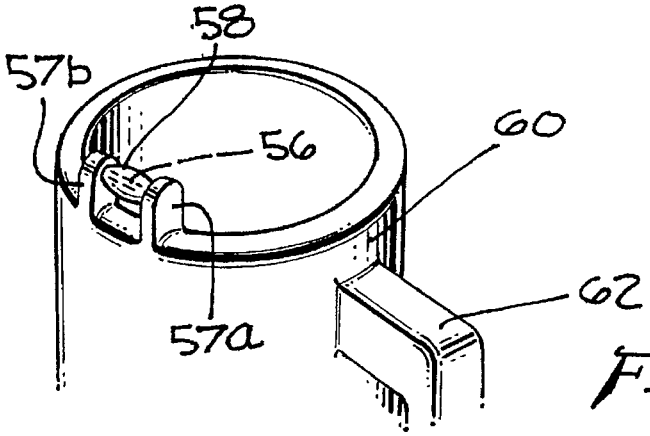
Fig. 5.

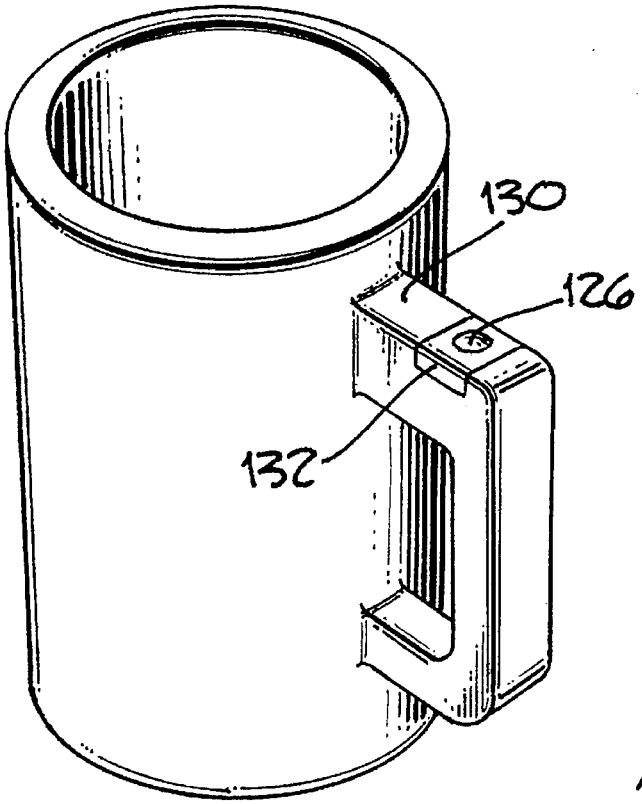
Fig. 17.
Fig. 19.
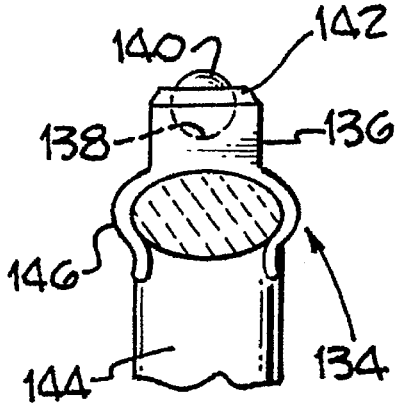
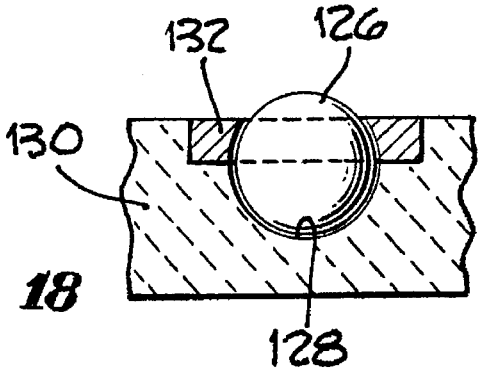
Fig. 18
Fig. 2a.
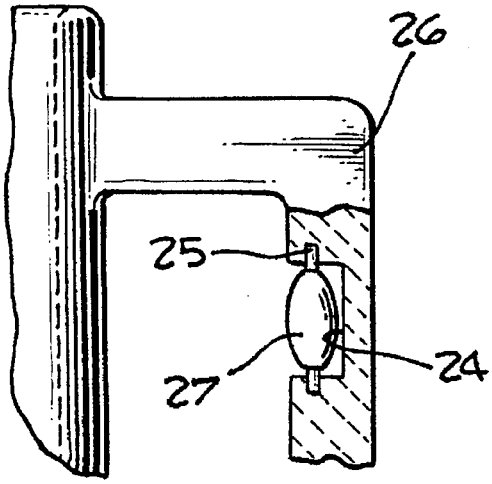
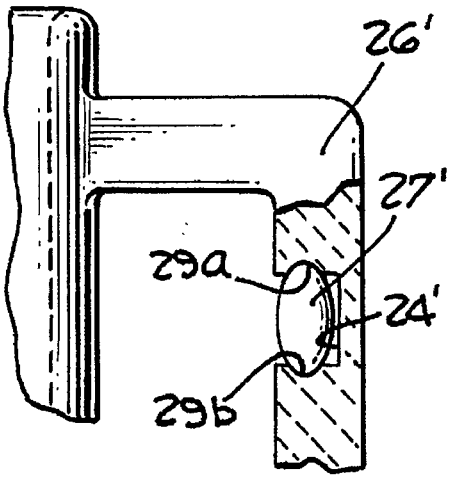
Fig. 2b.

Fig. 12.
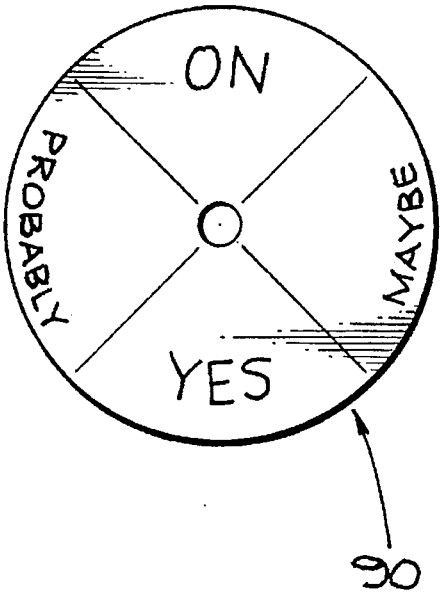
Fig. 14.
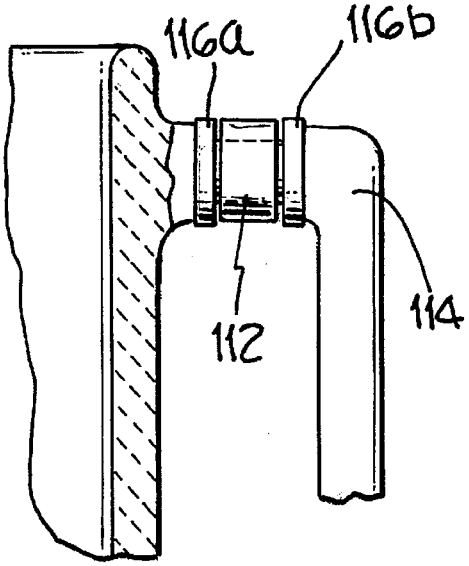
Fig. 13.
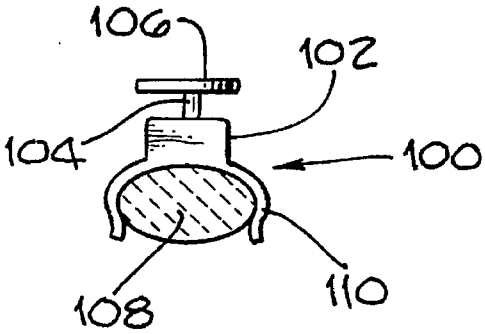
Fig. 15.
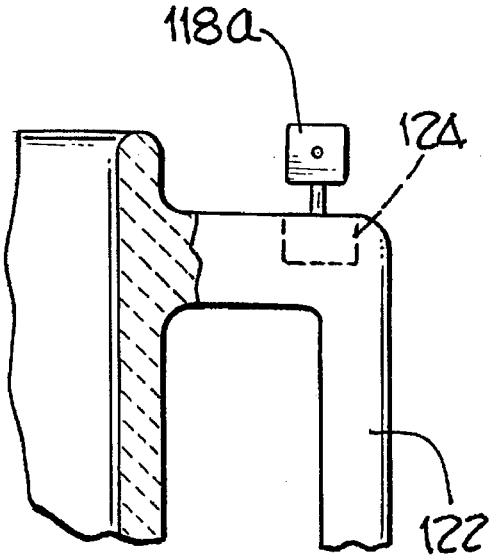
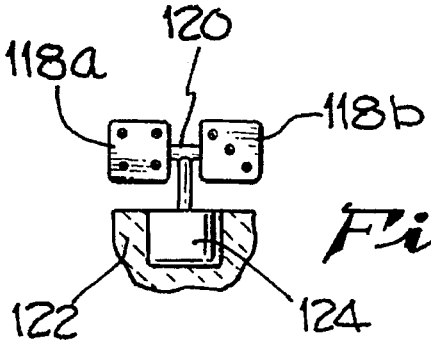
Fig. 16.

THERAPEUTIC HAND-HELD DRINKING APPARATUS

BACKGROUND OF THE INVENTION

1. Field of Invention

The present invention relates generally to a hand-held drinking apparatus and, more particularly, to a hand-held drinking apparatus having both therapeutic and amusement capabilities.

2. Description of the Related Art

A number of presently available therapeutic devices are designed to occupy a user's hands. The devices are manipulated by hand while the user works or day dreams in order to obtain therapeutic, stress-relieving effects. Many years ago, it was somewhat common for people to casually squeeze a piece of hard wax or putty. More recently, similar benefits have been obtained by squeezing small rubber balls and small bags filled with resilient granular material. However, as squeezing an object involves the use of most of the muscles in the hand, such prior art therapeutic devices can be quite fatiguing.

Meditation balls and "worry" beads are two other examples of hand-occupying therapeutic devices. A pair of meditation balls, which are normally made of steel or another metal, are held in one hand by the user and passed back and forth over one another through finger manipulations. "Worry" beads are simply a string of beads that the user manipulates with one or both hands.

Because the aforementioned therapeutic devices generally serve no other useful purpose, they tend to add to the clutter that accumulates on desks and in cars when not in use. Also, because they are not associated with a common utilitarian purpose, people tend to forget where they put them.

Similarly, everyday implements are often combined with amusement devices in order to increase the enjoyment of the user. Unfortunately, the vast majority of such devices are intended to amuse children, whose lives are considerably less stressful than those of adults. For example, infant high-chairs are often provided with toys, horns, etc. Another example is pencil erasers and drinking straws, which have been shaped in the form of cartoon characters. Still another example is disclosed in British Patent Specification No. 970,657, published in 1964, which is directed to a mug having a whistle built into the handle.

SUMMARY OF THE INVENTION

The general object of the present invention is to obviate, for practical purposes, the aforementioned problems in the art. In particular, one object of the present invention is to provide a device having a common utilitarian function that is capable of providing both therapeutic effects and an amusing diversion. Another object of the present invention is to provide a drinking apparatus that is capable of producing therapeutic effects during use. Still another object of the present invention is to provide a drinking apparatus having features that are amusing to both children and adults.

In order to accomplish these and other objectives, one embodiment of the present invention may include a liquid holding vessel, a handle extending outwardly from the vessel, and one or more objects mounted for rotation on the handle and defining an axis of rotation. The axis of rotation may be oriented in a variety of ways. For example, the axis of rotation may lie in a plane extending radially from the vessel or in a plane defined by the handle. Another preferred embodiment includes a rotating object that is associated with the vessel itself, as opposed to the handle.

The object may be mounted on the handle or vessel in such a manner that it is free to rotate about the axis of rotation. An axial member, upon which the object rotates, may be provided along the axis of rotation. The axial member may be secured to a drinking apparatus in a variety of ways. For example, the axial member may be permanently attached to the handle or vessel. The axial member may also be part of a sub-assembly that is permanently attached to the handle or vessel. Conversely, the axial member and rotating object may be part of a device that is adapted to be removably attached to the handle or vessel, thereby allowing the user to enjoy the advantageous aspects of the invention with a plurality of cups, mugs, glasses, other drinking apparatus, and other devices, such as telephones, which include handles. The axial member may also be eliminated altogether when an object adapted to rotate about a portion of the handle is used.

In accordance with another preferred embodiment of the present invention, the rotating object may be secured in such a manner that it is free to rotate in any direction. In particular, this preferred embodiment includes a rotating object that may be secured to a handle in a nesting fashion that allows multi-direction rotation.

Rotating objects in accordance with the present invention may, for example, be oval or spherically-shaped beads, corporate symbols, small toys, disks or other small items that a person may find tactilely or visually stimulating and/or amusing. The bead could also be shaped, textured and/or colored so as to resemble a football, baseball, basketball, hockey puck, tennis ball, soccer ball, dice or the like.

The present invention provides a number of advantages over the prior art. For example, the present invention does not require fatiguing squeezing to obtain the desired relaxing, therapeutic effects. The present invention also provides the therapeutic benefits of the prior art in conjunction with a device that performs an additional useful function, namely, holding water, coffee and other beverages. The fact that users will associate the present invention with a common utilitarian function will also make it less likely that they place it somewhere and forget about it. Moreover, because cups and mugs are commonly found on desks and in cars (with special provisions to prevent spills), the present invention will not add to desk or car clutter when not in use.

Turning to the present invention's amusement capabilities, the rotating object may be any object that a person would find stimulating or amusing. As any number of slogans, faces, corporate logos and other interesting designs may be printed on the object, the present invention may be specifically adapted to have amusement capabilities directed to a variety of different intended users. For example, a rotating disk may be provided in the form of a "decision wheel" which is divided into a plurality of segments. Each segment includes the answer to a question. As such, the user can ask the wheel a question, spin the wheel and receive an answer. The answers may be of a general nature, such as "yes, "no," "maybe," "probably," "always" and "never." They may also be of a more specific nature. If, for example, the wheel was intended to be used by a stockbroker, then the answers could be "buy" and "sell." In addition to the aforementioned therapeutic effects associated with the manual manipulation a rotating object while working or day dreaming, the question/answer feature provides an amusing diversion which may be taken advantage of as desired.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 1 is a perspective view in accordance with a first preferred embodiment of the present invention.

FIGS. 2*a* and 2*b* are partial side views in accordance with a second preferred embodiment of the present invention.

FIG. 3 is a partial side view in accordance with a third preferred embodiment of the present invention.

FIGS. 4*a* and 4*b* are partial side views in accordance with a fourth preferred embodiment of the present invention.

FIG. 5 is a partial perspective view in accordance with a fifth preferred embodiment of the present invention.

FIG. 12 is a top view in accordance the preferred embodiment illustrated in FIG. 11.

FIG. 13 is a side view in accordance with a ninth preferred embodiment of the present invention.

FIG. 14 is a side view in accordance with a tenth preferred embodiment of the present invention.

FIG. 15 is a side view in accordance with an eleventh preferred embodiment of the present invention.

FIG. 16 is a front view in accordance with the preferred embodiment illustrated in FIG. 15.

FIG. 17 is a perspective view in accordance with a twelfth preferred embodiment of the present invention.

FIG. 18 is a partial side section view in accordance with the preferred embodiment illustrated in FIG. 17.

FIG. 19 is a side view in accordance with a thirteenth preferred embodiment of the present invention.

DETAILED DESCRIPTION OF THE PREFERRED EMBODIMENTS

Figure 7:
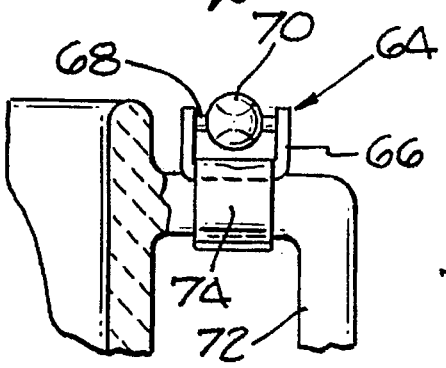
FIG. 7 is a front view in accordance the preferred embodiment illustrated in FIG. 6.

The following is a detailed description of a number of preferred embodiments of the present invention. This description is not to be taken in a limiting sense, but is made merely for the purpose of illustrating the general principles of the invention. The scope of the invention is defined by the appended claims.

Referring to FIG. 1, a drinking apparatus in accordance with a first preferred embodiment of the present invention may be a mug, such as that generally indicated by reference numeral 10. The mug includes a liquid holding vessel 12 having an open end 14, a closed end 16 and a handle 18. The handle includes a pair of support members 19*a* and 19*b* and a grip member 19*c*. A groove is formed between a pair of tabs 20*a* and 20*b* on handle support member 19*a*. The groove may also be a vertically facing groove formed in the top, outer portion of a support member as shown in FIGS. 4*a* and 4*b*. The groove may be oriented in a variety of ways and formed in any portion of the handle. As illustrated for example in FIG. 2*a*, a groove 24 may be formed-in the inner, grip portion of a handle 26 and, as illustrated for example in FIG. 3, a groove 28 may be oriented approximately 45° from the orientation of the groove in FIG. 1.

The exemplary embodiment illustrated in FIG. 1 also includes an axial member (or shaft) 30 which rotatably supports an object 32. The axial member shown in FIG. 1 extends completely through the object and is permanently affixed to tabs 20*a* and 20*b*. As illustrated in FIG. 3, an axial member may be provided in the form of a bolt 34 which extends through an aperture 36 formed in a portion 38 of a handle 40. A nut 42 holds bolt 34 in place. The bolt extend partially into a rotating object 44. The object is prevented from coming off of the bolt by a portion 46 of the handle and a small space 48 may formed between portion 46 and the object.

As illustrated for example in FIGS. 2*a* and 2*b*, an axial member is not necessarily required. As shown in FIG. 2*a*, an axial member 25 passes through a rotating object 27 and secures the object within groove 24. Conversely, in FIG. 2*b*, an object 27' is rotatably secured by a pair of detents 29*a* and 29*b* formed in a handle 26' having a groove 24'.

Referring to FIGS. 4*a* and 4*b*, an axial member may also be provided in the form of a pair of axial members (or shafts) 50*a* and 50*b* that are part of an insert 52 which is shaped in such a manner that it fits into a groove 54 in a handle. The insert may be secured to the groove with an adhesive or by other appropriate means. Axial members 50*a* and 50*b* may be replaced by a single axial member that passes completely through the object. The axial members may also be eliminated and replaced by a pair of detents, such as those shown in FIG. 2*b*, which rotatably secure the rotating object.

As shown by way of example in FIG. 5, an axial member 56, itself supported by a pair of tabs 57*a* and 57*b*, supports a rotating device 58. The tabs are attached a vessel 60, as opposed to a handle 62. However, the axial member may eliminated and replaced by a pair of detents formed in the tabs which rotatably secure the object. Obviously, this aspect of the invention could be employed in conjunction with drinking apparatus lacking a handle. Also, the axial member may be placed in a variety of locations on the vessel.

Figure 6:
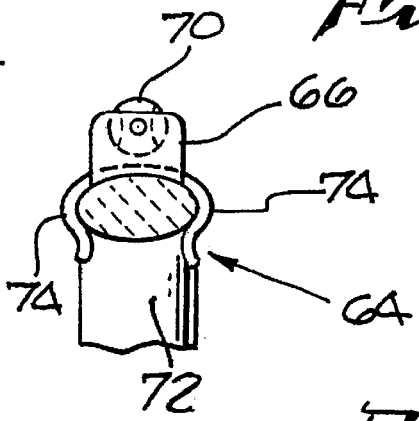
FIG. 6 is a side view in accordance with a sixth preferred embodiment of the present invention.

Referring to the preferred embodiments illustrated in FIGS. 6–9, the axial member and rotating object may be removably attached to the drinking apparatus. The exemplary device generally indicated by reference numeral 64 in FIGS. 6 and 7 includes a main body portion 66 which supports an axial member 68 that, in turn, supports a rotating object 70. Alternatively, the axial member may be eliminated and replaced by a pair of detents formed in the main body portion which rotatably secure the object. The main body portion may be secured to a handle 72 by a flexible clamp 74 that is adapted to be secured to the handle. Clamp 74 may be a resilient member attached to, or integrally formed with, main body portion 66 as shown in FIGS. 6 and 7. The clamp may also be a device with a threaded member that operates in a manner similar to a C-clamp. However, the clamp may be eliminated and replaced by an adhesive, such as a pressure sensitive adhesive, permanent or not, which coats the side of the main body portion in contact with the handle. Of course, the shape of the main body portion may be altered as needed to provide sufficient contact area. The adhesive may be applied at the time of assembly or may be pre-applied to the main body portion and covered with a removable backing sheet.

Figure 8:
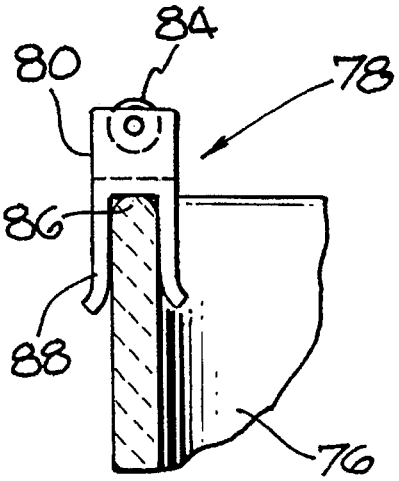
FIG. 8 is a side view in accordance with a seventh preferred embodiment of the present invention.
Figure 9:
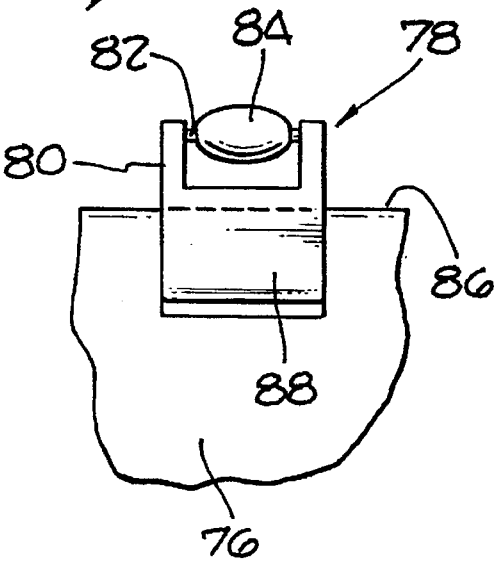
FIG. 9 is a front view in accordance the preferred embodiment illustrated in FIG. 8.

The exemplary device illustrated in FIGS. 8 and 9 is adapted to be secured to a Vessel 76. The device, which is generally indicated by reference numeral 78, includes a main body portion 80 which supports an axial member 82 that, in turn, supports a rotating object 84. Alternatively, the axial member may eliminated and replaced by a pair of detents formed in the main body portion which rotatably secure the object. The main body portion may be secured to a rim 86 of the vessel by a flexible clamp 88 that is adapted to be secured to the rim. Clamp 88 may be a resilient member attached to, or integrally formed with, main body portion 80 as shown in FIGS. 8 and 9. The clamp may also be a device with a threaded member that operates in a manner similar to a C-clamp. Clamp 88 may be preferably curved so that it conforms to the curved shape of the vessel and somewhat flexible so that it can conform to vessels of slightly different diameter. However, as noted above, the clamp may be replaced by adhesive which coats the side of the main body portion in contact with the handle and, if necessary, the shape of the main body portion may be altered to provide sufficient contact area. The adhesive may be applied at the time of assembly or may be pre-applied to the main body portion and covered with a removable backing sheet.

Figure 10:
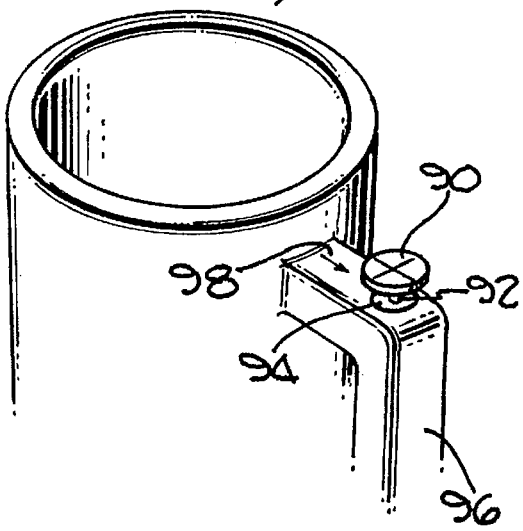
FIG. 10 is a partial perspective view in accordance with an eighth preferred embodiment of the present invention.
Figure 11:
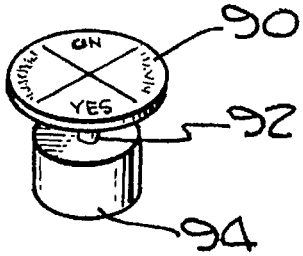
FIG. 11 is a perspective view in accordance the preferred embodiment illustrated in FIG. 10.

Referring now to the preferred embodiment illustrated in FIGS. 10–12, a rotating object may be provided in the form of a decision wheel or disk 90 which rotates with an axial member 92 that is rotatably mounted in a base 94. The axial member and wheel may be alternatively configured such that the axial member remains fixed and the wheel rotates about the axial member. The base is mounted in an aperture 96 formed in a handle 96. Decision wheel 90 may be divided into any number of segments, each segment corresponding to an answer to a question. As shown by way of example in FIG. 12, the decision wheel may be divided into four sections which indicate the answers "yes," "no," "probably" and "maybe." In order to have a question answered, the user spins the wheel and waits to see which section aligns with an indicia 98 that may be formed on the handle, as shown in FIG. 10, or on the vessel.

As illustrated for example in FIG. 13, the decision wheel may be removably attached to the drinking apparatus. The exemplary device generally indicated by reference numeral 100 includes a main body portion 102 which supports an axial member 104 that, in turn, supports a decision wheel 106. The main body portion may be secured to a handle 108 by a flexible clamp 110 that is adapted to be secured to the handle. As discussed above with reference to FIGS. 6 and 7, clamp 110 may be a resilient member attached to, or integrally formed with, main body portion 102 or rigid device with a threaded member that operates in a manner similar to a C-clamp. Decision wheel device 100 may also be configured in a manner similar to the device shown in FIGS. 8 and 9 so that the decision wheel can be secured to the rim of a vessel. Also, the clamp may be replaced by adhesive in the manner described above with respect to FIGS. 6–9.

Referring to the exemplary embodiment illustrated in FIG. 14, a rotating object may be provided in the form of a hollow cylinder 112 that is arranged on a handle 114. The cylinder may be held in place by a pair of stops 116*a* and 116*b*. Alternatively, the handle may be provided with a reduced diameter portion and the cylinder be provided on the reduced diameter portion. Cylinder 112 may be arranged on the top portion of handle 114, as shown, or side or bottom portions.

Turning to the preferred embodiment illustrated in FIGS. 15 and 16, rotating objects may be provided in the form of a pair of dice 118*a* and 118*b*. The dice rotate about an axial member 120 that is secured to a handle 122 by a plug 124. The plug is adapted to be placed in an aperture formed in handle 122. The plug arrangement may be replaced by a resilient clamp such as that illustrated in FIGS. 6 and 7 or a C-clamp device. The dice may also be secured to the rim of a vessel, either permanently in a manner similar to that shown in FIG. 5, or removably through the use of a resilient clamp similar to that shown in FIGS. 8 and 9 or a C-clamp device.

Finally, an axis-less configuration is illustrated for example in FIGS. 17–19. Referring to the numbered elements in FIGS. 17 and 18, a rotating object 126 may be placed in an indentation 128 formed a handle 130. The indentation has a shape corresponding to that of the rotating object. A cap 132, the inner portion of which is also shaped to correspond to the shape of rotating object 126, may be secured to the handle to hold the object in place. The rotating object is in slidable contact with the surface of the indentation and is free to rotate in any direction within the space defined by the indentation and cap. The indentation may be formed in any portion of the handle including, but not limited to, the top, outer portion of the handle, as shown in FIG. 17, and the inner, grip portion in a manner similar to that shown in FIG. 6. It may also be formed at an angle in a manner similar to that shown in FIG. 4 or on the rim of the vessel itself.

Turning to FIG. 19, the freely rotating object shown in FIGS. 17 and 18 may be removably attached to the drinking apparatus. The exemplary device generally indicated by reference numeral 134 includes a main body portion 136 having an indentation 138 that supports a rotating object 140. A cap 142 is provided to hold the rotating object in place. The main body portion may be secured to a handle 144 by a flexible clamp 146. The clamp may be of the resilient or C-clamp varieties discussed above with respect to FIGS. 6–9 and 13, or replaced by adhesive in the manner described above with respect to FIGS. 6–9.

Although the present invention has been described in terms of the preferred embodiments above, numerous modifications and/or additions to the above-described preferred embodiments would be readily apparent to one skilled in the art.

For example, the present invention is not limited to cylindrically-shaped mugs. Cups without handles may also be used, as may vessels of various sizes and shapes. The rotating object could be associated with the side of the vessel as well as its rim. Additionally, a plurality of rotating objects may be included on a single drinking apparatus and/or a single axial member. With respect to the various axis of rotation, the object may either rotate about a generally fixed axial member or be secured to an axial member which itself rotates. The devices shown in FIGS. 6–9, 13 and 19 are not limited to used with drinking apparatus. Rather, they may be used in conjunction with any apparatus that includes a hand-held handle, such as a telephone.

It is intended that the scope of the present invention extends to all such modifications and/or additions and that the scope of the present invention is limited solely by the claims set forth below.

We claim:

1. A hand-held drinking apparatus, comprising:

a vessel having an open end and a closed end;

a handle associated with the vessel and extending outwardly therefrom;

a shaft secured to the handle; and an object mounted for rotation on the shaft and defining an axis of rotation located in a plane extending substantially radially from the vessel and which intersects the vessel at at least one of the open end and the closed end.

2. A hand-held drinking apparatus as claimed in claim 1, wherein the object comprises a bead.

3. A hand-held drinking apparatus as claimed in claim 1, further comprising:

a groove formed in the handle, wherein the shaft extends at least partially across the groove.

4. A hand-held drinking apparatus as claimed in claim 3, wherein the shaft extends completely across the groove.

5. A hand-held drinking apparatus as claimed in claim 3, further comprising an axis insert associated with the groove, the axis insert defining a shape substantially conforming to the groove and including the shaft.

6. A hand-held drinking apparatus as claimed in claim 3, wherein the shaft is fixed and the object rotates about the shaft.

7. A hand-held drinking apparatus as claimed in claim 1, wherein the vessel defines a longitudinal axis and the axis of rotation is substantially parallel to the longitudinal axis of the vessel.

8. A hand-held drinking apparatus as claimed in claim 7, wherein the shaft defines opposing longitudinal ends and the object is associated with one of longitudinal ends.

9. A hand-held drinking apparatus as claimed in claim 7, wherein the object comprises a disk.

10. A hand-held drinking apparatus as claimed in claim 9, wherein the handle includes first indicia marking a predetermined location on the handle and the disk includes plurality of circumferentially spaced second indicia located on the surface of the disk.

11. A hand-held drinking apparatus as claimed in claim 10, wherein at least one of the second indicia comprises a word selected from the group of words consisting of "yes, "no," "maybe," "probably," "always" and "never."

12. A hand-held drinking apparatus as claimed in claim 1, wherein the vessel defines a longitudinal axis and the longitudinal axis and the axis of rotation define an angle therebetween substantially less than 90°.

13. A hand-held drinking apparatus comprising a vessel having an open end and a closed end, a handle associated with the vessel and extending outwardly therefrom in a predetermined direction, a shaft mounted on the handle, and a bead defining an outer surface mounted for rotation on the shaft such that at least half of the outer surface of the bead is visible from a point in spaced relation to the drinking apparatus, wherein the handle defines an uppermost surface and the entire bead is located above the uppermost surface of the handle.

14. A hand-held drinking apparatus as claimed in claim 13, wherein the handle defines a groove and the shaft extends at least partially across the groove.

15. A hand-held drinking apparatus as claimed in claim 13, the shaft extends in a direction transverse to the predetermined direction.

16. A hand-held drinking apparatus, comprising:

a vessel having an open end and a closed end;

a handle associated with the vessel and extending outwardly therefrom, the handle defining an uppermost surface and including at least one support member attached to the vessel and a grip member associated with the at least one support member, wherein a generally vertically-extending plane passes through the grip member and support member; and an object rotatably mounted on the handle in such a manner that it is permanently fixed in a predetermined location on the handle, the object defining an axis of rotation located in the generally vertically-extending plane at one of a level corresponding to the uppermost surface of the handle and a level in spaced relation to the uppermost surface of the handle and the handle itself.

17. A hand-held drinking apparatus as claimed in claim 16, wherein the object defines an outer surface and at least half of the outer surface of the object is visible from a point in spaced relation to the drinking apparatus.

18. A hand-held drinking apparatus, comprising:

a vessel having an open end and a closed end;

a handle associated with the vessel and extending outwardly therefrom, the handle defining an uppermost surface; and a rotatable object secured to the handle, the rotatable object defining opposing ends and an axis of rotation between the opposing ends, the entire axis of rotation between the opposing ends of the rotatable object being located at one of a level corresponding to the uppermost surface of the handle and a level above the uppermost surface of the handle and the handle itself, wherein the object defines an outer surface and at least half of the outer surface of the object is visible from a point in spaced relation to the drinking apparatus.

19. A hand-held drinking apparatus as claimed in claim 18, wherein the axis of rotation extends in a direction transverse to the handle.

20. A hand-held drinking apparatus as claimed in claim 1, wherein the handle defines an uppermost surface and the entire shaft is located at one of a level corresponding to the uppermost surface of the handle and a level in spaced relation to the uppermost surface of the handle and the handle itself.

21. A hand-held drinking apparatus as claimed in claim 1, wherein the object defines an outer surface and at least half of the outer surface of the object is visible from a point in spaced relation to the drinking apparatus.

22. A hand-held drinking apparatus as claimed in claim 1, wherein the handle defines an uppermost surface and the entire object is located in spaced relation to the uppermost surface of the handle.

* * * * *